United States Patent [19]

Grünwald et al.

[11] Patent Number: 4,603,667

[45] Date of Patent: Aug. 5, 1986

[54] DEVICE FOR FUEL INJECTION IN COMBUSTION CHAMBERS

[75] Inventors: Werner Grünwald, Gerlingen; Ernst Imhof, Münchingen; Iwan Komaroff, Regensburg; Günther Schmid, Stuttgart; Kurt Schmid, Ditzingen-Schöckingen, all of Fed. Rep. of Germany

[73] Assignee: Robert Bosch GmbH, Stuttgart, Fed. Rep. of Germany

[21] Appl. No.: 672,706

[22] PCT Filed: Apr. 27, 1984

[86] PCT No.: PCT/DE84/00098

§ 371 Date: Oct. 19, 1984

§ 102(e) Date: Oct. 19, 1984

[87] PCT Pub. No.: WO84/04800

PCT Pub. Date: Dec. 6, 1984

[30] Foreign Application Priority Data

May 20, 1983 [DE] Fed. Rep. of Germany ..... 3318459

[51] Int. Cl.[4] ..... F23Q 7/00

[52] U.S. Cl. ..... 123/297; 123/298; 123/543; 123/145 A; 361/264; 219/267

[58] Field of Search ..... 123/297, 298, 305, 145 A, 123/549, 543, 179 G; 361/260, 266; 219/267, 270

[56] References Cited

U.S. PATENT DOCUMENTS

| | | | |
|---|---|---|---|
| Re. 31,908 | 6/1985 | Petrik et al. | 123/145 A |
| 1,379,060 | 5/1921 | Sumner | 123/145 A |
| 1,463,855 | 8/1923 | Tartrais | 123/145 A |
| 1,609,688 | 12/1926 | Briggs | 123/145 A |
| 1,927,562 | 9/1933 | Dorner et al. | 123/145 A |
| 1,935,171 | 11/1933 | Woolson | 123/145 A |
| 3,996,915 | 12/1976 | Demetrescu | 123/297 |
| 4,112,577 | 9/1978 | Mann | 123/145 A |
| 4,211,204 | 7/1980 | Glaunor et al. | 123/145 A |
| 4,292,934 | 10/1981 | Knawles | 123/145 A |
| 4,317,434 | 3/1982 | Kato | 123/145 A |
| 4,359,977 | 11/1982 | Sperner et al. | 123/145 A |
| 4,426,568 | 1/1984 | Kato et al. | 123/145 A |
| 4,448,160 | 5/1984 | Vosper | 123/297 |
| 4,450,795 | 5/1984 | Schaich | 123/297 |
| 4,450,796 | 5/1984 | Schaich | 123/297 |
| 4,475,030 | 10/1984 | Bailey | 123/145 A |

FOREIGN PATENT DOCUMENTS

| | | | |
|---|---|---|---|
| 3224048 | 12/1983 | Fed. Rep. of Germany | 123/297 |
| 2078853 | 1/1982 | United Kingdom | 123/297 |

*Primary Examiner*—Raymond A. Nelli
*Attorney, Agent, or Firm*—Michael J. Striker

[57] ABSTRACT

Device for fuel injection in combustion chambers of, in particular, selfigniting combustion engines with an injection nozzle (10) and a subsequently switched incandescent wire (20) which has a conduit (30) surrounded by a double heating layer (33) on the inside for passing through of the injection streams. The double heating layer (33) consists of an inner heating layer (35) which is separated from a second heating layer (37) by an electrical insulator. In the parallel as well as the series switching of the two heating layers (35,37), a two stage heating of the double heating layer (33) is possible. The inner heating layer (35) reaches the required end temperature required for ignition in a relative short time, while the second heating layer (37) assures a high energy density of the ceramic support mass (38).

15 Claims, 10 Drawing Figures

DEVICE FOR FUEL INJECTION IN COMBUSTION CHAMBERS

STATE OF THE ART

The invention is based on a device for fuel injection in accordance with the type of the main claim. One single heat layer is provided in the incandescent wire in a known device of this type. This is disadvantageous in that the temperature of the heat layer changes with the thermic pulsation of the passing medium. In order to prevent this, the heat layer must be overdimensioned so that an energy loss occurs.

Due to the high heat capacity of the ceramic heat protection layer of the incandescent wire and its structure, the hitherto known devices require a relative long time interval for reaching the required end temperature for igniting or preliminary heating of the fuel-air mixture.

ADVANTAGES OF THE INVENTION

The device with the characterizing features of the main claim in accordance with the invention is advantageous in that the required temperature for preheating is reached at a relative short time. The inner heat layer can practically heat up into the ceramic protective layer without any heat transfer. The simultaneously heated second heat layer takes over the heating of the ceramic protection layer and assures a high and relative constant heat capacity of the protection layer. Therefore, thermic pulsations of the fuel-air mixture cause only very minute temperature changes of the heat layer. At the location of the flowing mixtures the device has a high and relative constant energy density. Simultaneously, the second heat layer prevents a thermic overloading of the inner heat layer.

Advantageous further embodiments and improvements of the features stated in the main claim are possible with the measures stated in the subclaims.

The inner heating layer is advantageously mechanically stabilized by means of the manufacturing method. An evaporation of the platinum is prevented in the heat layers consisting, for example, of different platinum alloys, so that a long time change of the heat layer resistance is prevented. Threby, the device has an excellent life span and permits an economical manufacturing by means of modern manufacturing processes.

BRIEF DESCRIPTION OF THE DRAWINGS

The drawings, disclosing an illustrative embodiment of the present invention, and which serve to present the various objectives and advantages hereof, are as follows.

DESCRIPTION OF THE EXEMPLIFIED EMBODIMENTS

Figure 1:
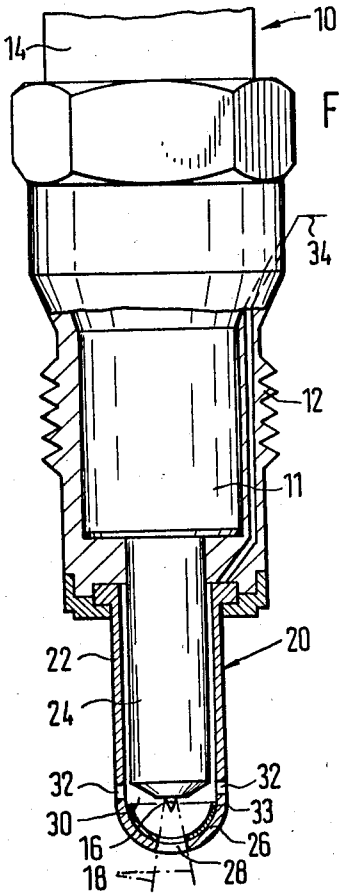
FIG. 1 is a partially sectioned side view of a part of an injection nozzle at the side of the combustion chamber in accordance with one exemplified embodiment.

The injection nozzle 10 in accordance with FIG. 1 has a jet body 11 which is clamped on a jet holder 14 by means of a screw cap 12. Parts 11 to 14 are commercially available and are therefore not shown in detail and also not described. The injection nozzle 10 is designed as a throttle pin jet nozzle, whose valve needle supports a throttle pin 16 extending from the jet body 11. The lines 18 indicate a jet cone of the fuel jet stream. Instead of a throttle pin nozzle one could provide an apertured nozzle.

A relatively thin walled tube like incandescent wire 20 is mounted on the screw cap 12, whose cylindrical jacket segment 22 encompasses a shaft 24 of the jet body 11 with a tight clearance. The bottom 26 of the incandescent wire 20 is spherically curved and provided with a central bore 28 for passage of the jet cone 18. A conduit 30 is formed between the bottom 26 and the front wall of the jet body 11, wherein lateral openings 32 discharge into incandescent wire 20. The incandescent wire 20 supports at its bottom 26 a schematically illustrated double heating layer 33 in FIG. 1, which is connectable by means of an electrical coonection 34 with a power source, not shown.

Figure 2:
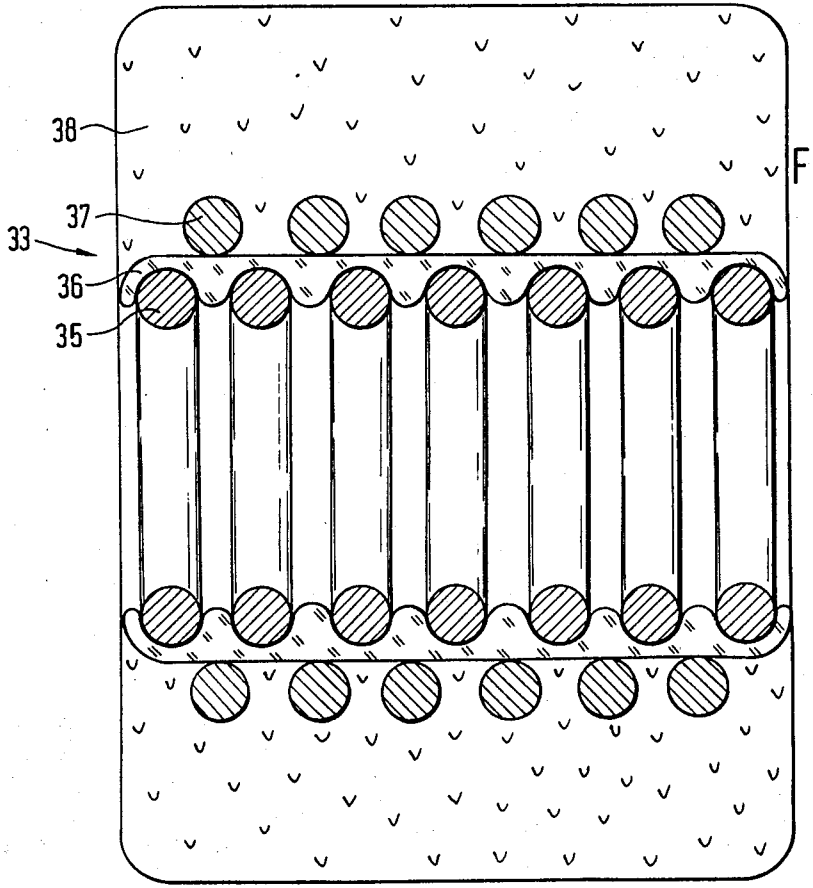
FIG. 2 is a view showing longitudinal section through an exemplified embodiment of the incandescent wire in a schematic illustration.
Figure 3:
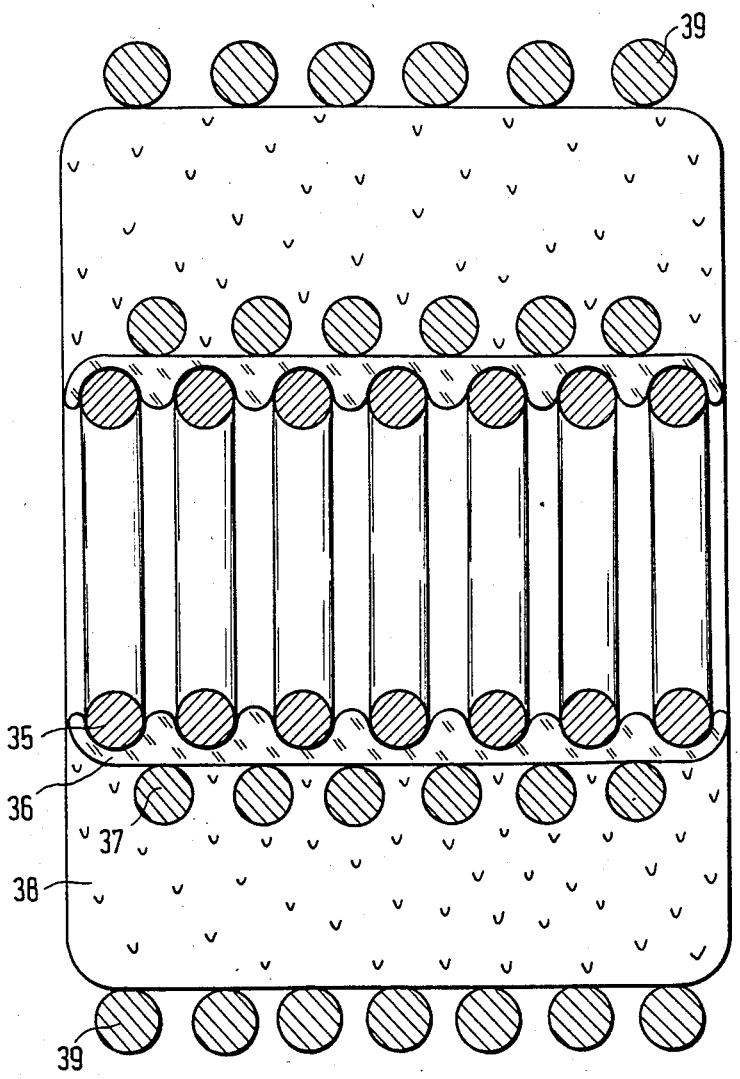
FIG. 3 is a view showing a modification of the exemplified embodiment in accordance with FIG. 2.

This double heating layer 33 is illustrated at an enlarged scale in the tube like area of the incandescent wire 20, FIG. 2. A thin dielectric Insulating layer 36 is applied on an inner heating layer 35 which preferably is designed as a heating coil. This insulating layer 36 may be an $Al_2O_3$-layer, for example. The heating layer 35 is partially imbedded into this insulating layer 36. A second heating layer 37 is provided on the outside of insulating layer 36. Both heating layers 35,37 may be designed as heating coils or may be applied in a layer technique, for example, with the assistance of the plug printing process. However, with a tubelike incandescent device, the inner heating layer 35 should be advantageously designed as wire coils. The second heating layer 37 is encompassed completely by a massive ceramic support 38. This support 38 serves for a mechanical stabilisation of the double heating layer 33 and for increasing the heat capacity. As illustrated in FIG. 3, a heating layer 39 may be applied on support 38. This additionally increases and stabilizes the heat capacity of support 38. The two heating layers 35,37 may be switched in series as well as parallel. Furthermore, a common or one each separate electrical connection are possible for the two heating layers.

If the heating layers 35,37 are switched electrically in series, the inner heating layer 35 is made from a material with a low, negative or positive temperature coefficient in accordance with the invention. For this purpose, it had been shown to be advantageous to use a platinum alloy with about 5 to 10% by weight Wolfram or 30% by weight Iridium. The heating layer 37 should be made from a material with a high positive temperature coefficient. For example, platinum is suitable. After switching on the heater voltage, the largest part of the voltage drops on the relative high Ohm inner heating layer 35. Thereby, the same is vigorously heated. The outer heating layer 37 is also rapidly heated due to the Joule heat dissipated while the current passes through and by the heat amount of the inner heating layer 35. Due to the temperature increase in the direct environment of the heating layer 37, the resistor of the heating layer 37 increases due to the high positive temperature coefficient (PTC-resistor). Thus, the efficiency emission of the heating layer 35 is limited, so that a thermical overload of heating layer 35 cannot occur. The heating layer 37 may be designed as a heating coil or may be applied with a layer technique, for example, with the plug printing process with thick layer pastes like, for example, the commercially available Du Pont-type 4058. However, with such ceramic PTC-resistors it has to be taken into consideration that the switching point is in the temperature range between 100° and 200°, but that the incandescent wire gets much hotter. Advantageously, the heating layer 37 is provided in the area of the jet body.

In a parallel circuit of the two heating layers 35,37 a material with high positive temperature coefficients is used for the heating layer 35 and a material with low negative or positive temperature coefficients (NTC-or PTC-resistance) for the heating layer 37. Due to the low cold resistance, the inner heating layer 35 again heats up rapidly.

In accordance with the invention the heating takes place in two steps for the two heating layers 35,37, also with the parallel circuit. The heating layer 35 heats rapidly and reaches in a relativ short time, which preferably is smaller than 0,5 seconds, the end temperature for the ignition process. The second heating layer 37 heats the ceramic layer, increases and stabilizes the heat capacity of the total incandescent wire. A thermical overheating of the heating layer 35 is also prevented by the heating layer 37 in this circuit arrangement.

Figure 4:
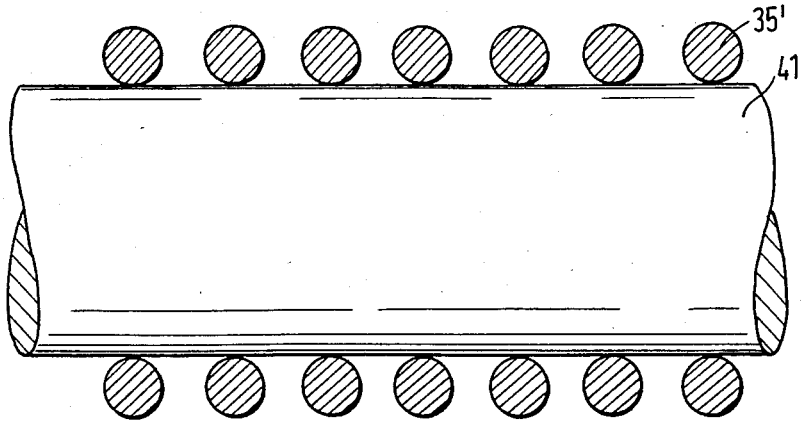
FIGS. 4–6 are views schematically showing process steps for making the exemplified embodiment in accordance with FIG. 2, wherein in FIG. 4 a heating layer is wound on a mandrel, in FIG. 5 an electrically insulating layer is applied on the heating layer, and in FIG. 6 a second heating layer is then applied.
Figure 5:
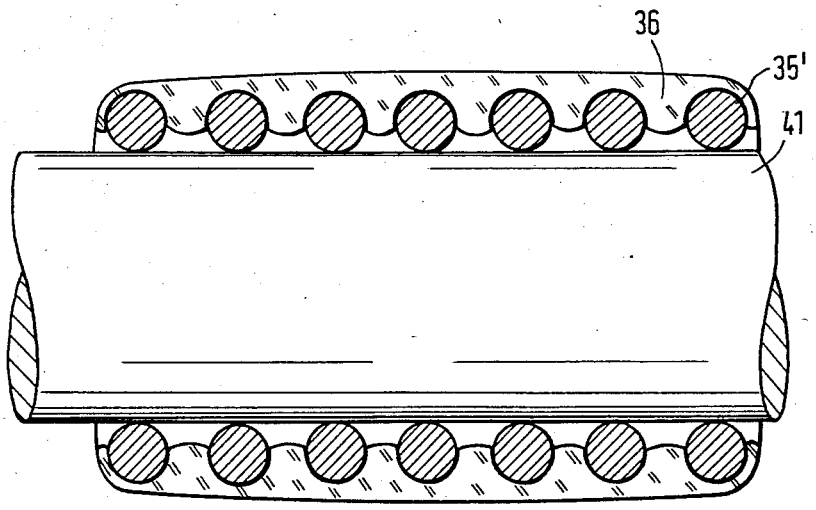
Figure 6:
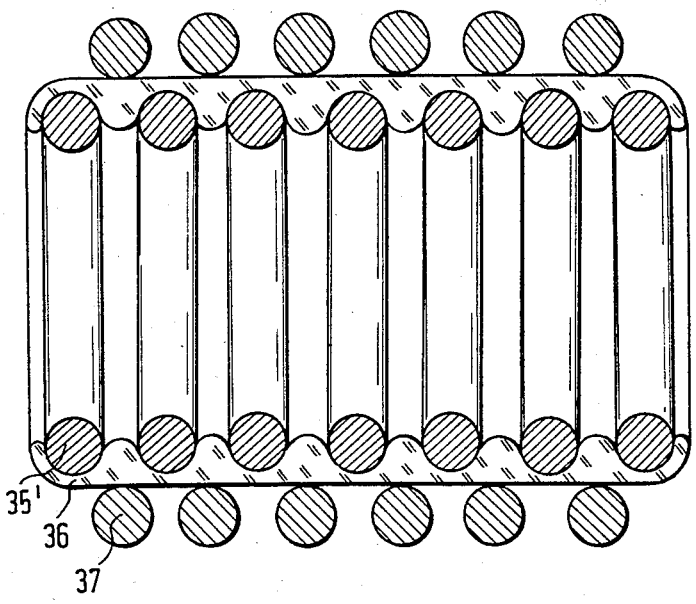

The manufacturing of this double heating layer 33 is performed in the following steps in accordance with the invention being illustrated in FIGS. 4 to 6. The heating layer 35 is wound in form of a heating coil 35' onto a mandrel 41. Subsequently, a thin layer of an electrically insulating layer 36, preferably made from $Al_2O_3$ is printed on or brushed on in accordance with the plug print process, for example, on the heating coil 35'. A second heating layer 37 is then applied. A dough-like, plasticizable ceramic mass may be applied on the outside over the total arrangement as a support 38. However, a commercially available ceramic tube may be placed over the heating layer 37 and connected with commercially available ceramic adhesive. Subsequently, the mandrel 41 is removed from the incandescent wire. The heating layer 35 can now be coated from the inside with electrically insulating paste, so that an evaporation of the platinum and thereby a long time change of the resistor of the heating layer is prevented. Finally, the total icandescent wire is annealed.

Figure 7:
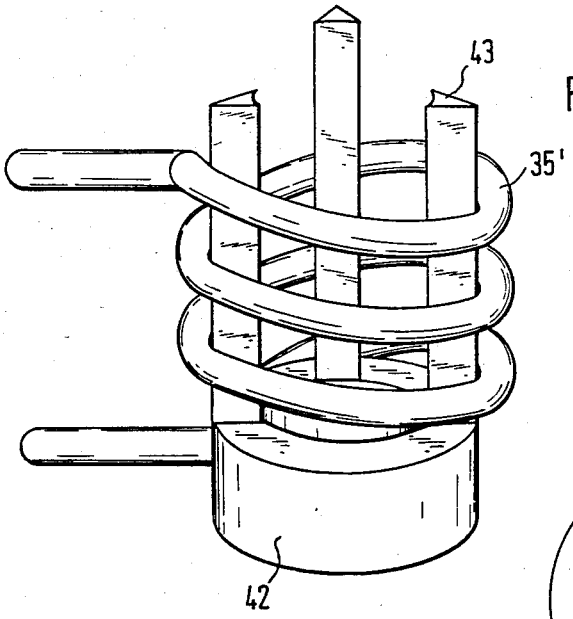
FIG. 7 is a view showing a support element for a heating coil from the exemplified embodiment in accordance with FIG. 2.

In the exemplified embodiment in accordance with FIG. 7, the heating layer 37 is wound as a heating coil 35' onto a ceramic support element. This support element 42 has a plurality of ceramic pins 43 which have substantially triangular shaped cross sections. The heating coil 35 is wound onto the outside of these ceramic pins 43. In accordance with the invention it may have a relative thin cross section and bay higher Ohm as the ones hitherto known. Due to the insignificant contact points of the heating coil 35' with the ceramic points 43, the heat transfer is substantially reduced; thereby, the mechanical stability of the heating coil 35' is maintained and assured. Due to the subsequent annealing the heating coil 35' is clamped into the pins 43 at the contact points and simultaneously retightened radially because of the dimensional reduction of the ceramic. If need be, the heating coil 35' may be fixed with a ceramic adhesive before annealing.

Figure 8:
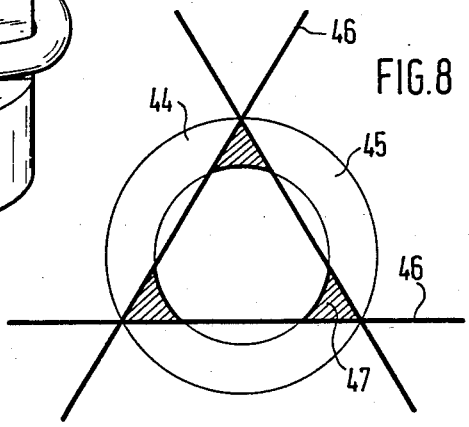
FIG. 8 is a view schematically showing a manufacturing process for the support element of FIG. 7.

The manufacturing of the ceramic pins 43 is illustrated in detail in FIG. 8. Tube pieces 45 are separted or milled off at cutting planes 46, which simultaneously form an even sided triangle, from a ceramic tube 44 which advantageously consists of "preannealed" ceramic, i.e., it is pressed but not yet annealed. The center of the triangle is positioned in the axis of the ceramic tube 44. Therefore, three ceramic pins 43 remain standing. Without deviating from the basis thoughts, a plurality of pins may be made by means of a plurality of cutting planes.

Figure 9:
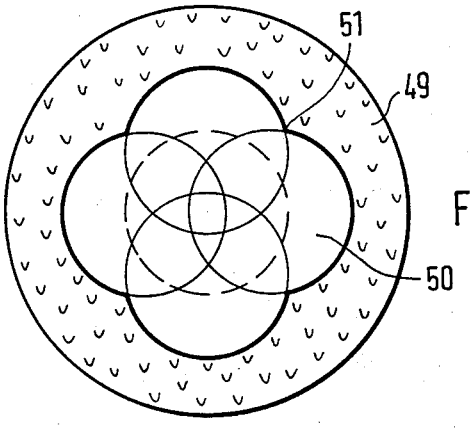
FIG. 9 is a view showing another support element for heating coil from the exemplified embodiment in accordance with FIG. 2.
Figure 10:
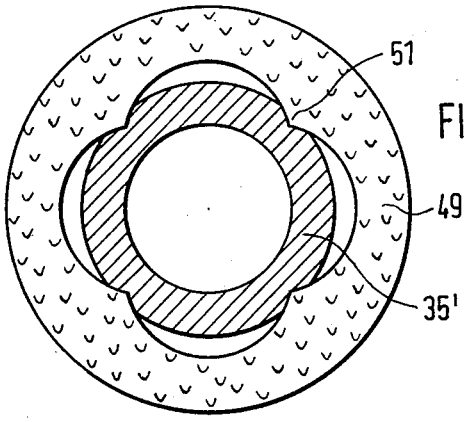
FIG. 10 is a view schematically showing a manufacturing process for the support element in accordance with FIG. 9.

In the exemplified embodiment in accordance with FIG. 9, four equally large overlapping longitudinal bores 50 are bored per a "preannealed" ceramic cylinder 49. The center points of the longitudinal bores 50 are located in a circle, whose center point is positioned on the axis of ceramic cylinder 49. The result is four ribs 51 at which the heating coils 35' are arranged, as illustrated in detail in FIG. 10. Therefore, ribs 51 support the heating coils 35' which may be fixed with a ceramic adhesive, if need be. Subsequently, the total arrangement is annealed.

We claim:

1. Device for fuel injection in combustion chambers of, in particular, selfigniting combustion engines with an injection nozzle and a subsequently switched incandescent wire which has a conduit surrounded by heatable walls through which the injection streams of the fuel can pass through substantially unhindered, characterized in that at the side of the combustion chamber at least two superimposed heating layers (35,37) are provided and separated from each other by insulation (36) in the conduit of the incandescent wire (20).

2. Device in accordance with claim 1, characterized in that two heating layers (35,37) are provided which are separated by an insulator (36), preferably made from $Al_2O_3$, and encompassed by a ceramic support mass (38).

3. Device in accordance with claim 1, characterized in that the heating layers (35,37) consist of one each resistor wire.

4. Device in accordance with claim 2, characterized in that the heating layers (35,37) consist of one each resistor wire.

5. Device for fuel injection in combustion chambers of, in particular, selfigniting combustion engines with an injection nozzle and a subsequently switched incandescent wire which has a conduit surrounded by heatable walls through which the injection streams of the fuel can pass through substantially unhindered, characterized in that at the side of the combustion chamber at least two superimposed heating layers (35, 37) are provided and separated from each other by insulation (36) in the conduit of the incandescent wire (20), the heating layers (35, 37) are electrically and parallel switched and that the inner heater layer (35) consists of a material with high temperature coefficient (PTC-resistor) and the second heating layer (37) of a material with low temperature coefficients (NTC-or PTC-resistor).

6. Device in accordance with claim 5, characterized in that the heating layers (35,37) are printed onto a support (36,38) by means of a plug printing process.

7. Device in accordance with claim 6, characterized in that one heating layer is mounted on a support element (42) consisting of a plurality of ceramic pins.

8. Device in accordance with claim 7, characterized in that the ceramic pins (43) are worked out by a plurality of cuts from a hollow ceramic element (44).

9. Device in accordance with claim 6, characterized that one heating layer (35') is provided within a support element (42) which is so shaped that the heating layer (35') engages only at a plurality of ribs (51).

10. Device in accordance with claim 9, characterized in that the support element (42) consists of a full cylinder (49) from which a plurality of equally large overlapping bores (50) are bored out, whose center points are positioned in a circle whose center point is in the axis of cylinder (49).

11. Device in accordance with claim 1, characterized in that the heating layers (35,37) are printed onto a support (36,38) by means of a plug printing process.

12. Device in accordance with claim 1, characterized in that one heating layer is mounted on a support element (42) consisting of a plurality of ceramic pins.

13. Device in accordance with claim 1, characterized that one heating layer (35') is provided within a support element (42) which is so shaped that the heating layer (35') engages only at a plurality of ribs (51).

14. Device for fuel injection in combustion chambers of, in particular, selfigniting combustion engines with an injection nozzle and a subsequently switched incandescent wire which the injection streams of the fuel can pass through substantially unhindered, characterized in that at the side of the combustion chamber at least two superimposed heating layers (35, 37) are provided and separated from each other by insulation (36) in the conduit of the incandescent wire (20), the heating layers (35, 37) are electrically switched in series and that the inner heating layer (35) consists of a material with a low temperature coefficient (NTC-or PTC-resistor) and the second heating layer (37) of a material with high temperature coefficient (PTC-resistor).

15. Device for fuel injection in combustion chambers of, in particular, selfigniting combustion engines with an injection nozzle and a subsequently switched incandescent wire which has a conduit surrounded by heatable walls through which the injection streams of the fuel can pass through substantially unhindered, characterized in that at the side of the combustion chamber at least two superimposed heating layers (35, 37) are provided and separated from each other by insulation (36) in the conduit of the incandescent wire (20), the heating layers (35, 37) consist of one each resistor wire, the heating layers (35, 37) are electrically switched in series, and the inner heating layer (35) consists of a material with a low temperature coefficient (NTC-or PTC-resistor) and the second heating layer (37) of a material with high temperature coefficient (PTC-resistor).

* * * * *